US006085933A

United States Patent [19]

Brunazzo

[11] Patent Number: 6,085,933

[45] Date of Patent: Jul. 11, 2000

[54] BASKET WITH AN ARC SHAPED HANDLE

[75] Inventor: Roberto Brunazzo, Lonate Pozzolo, Italy

[73] Assignee: Brunazzo s.n.c., Lonate Pozzolo, Italy

[21] Appl. No.: 09/308,045

[22] PCT Filed: Nov. 15, 1996

[86] PCT No.: PCT/IT96/00212

§ 371 Date: May 13, 1999

§ 102(e) Date: May 13, 1999

[87] PCT Pub. No.: WO98/21996

PCT Pub. Date: May 28, 1998

[51] Int. Cl.[7] ..... B65D 25/32

[52] U.S. Cl. ..... 220/760; 220/775; 220/776

[58] Field of Search ..... 220/759, 760, 220/773, 774, 775, 776

[56] References Cited

U.S. PATENT DOCUMENTS

| | | | |
|---|---|---|---|
| 264,795 | 9/1882 | Timberlake | 220/775 |
| 886,011 | 4/1908 | Nichols | 220/775 |
| 2,405,310 | 8/1946 | Larkin . | |
| 2,901,144 | 8/1959 | Haustrup | 220/775 |
| 3,358,877 | 12/1967 | Eckhoff | 220/775 |
| 4,624,382 | 11/1986 | Tontarelli . | |
| 4,742,915 | 5/1988 | Ringer . | |
| 4,884,837 | 12/1989 | Nakazawa . | |

FOREIGN PATENT DOCUMENTS

| | | |
|---|---|---|
| 1 334 862 | 7/1963 | France . |

*Primary Examiner*—Stephen Castellano
*Attorney, Agent, or Firm*—Young & Thompson

[57] ABSTRACT

The tray (1) of the basket bears on each side at least one first engagement means (3) and the handle (2) bears at each of its ends at least one second engagement means (4), the first and second engagement means being suited to coupling so that the tray and handle become solidly and permanently locked to one another forming a single object.

10 Claims, 3 Drawing Sheets

BASKET WITH AN ARC SHAPED HANDLE

CROSS REFERENCE TO RELATED APPLICATION

This is the 35 USC 371 national stage of international application PCT/IT96/00212 filed on Nov. 15, 1996, and which designated the United States of America.

FIELD OF THE INVENTION

The present invention concerns a basket with arc shaped handle, more precisely it concerns a basket comprising an arc shaped or upturned U handle extending from one side to the other of the basket.

BACKGROUND OF THE INVENTION

Baskets with arc shaped or upturned U handles, that we shall simply term "handle" herein, of the kind concerned with this application, can be made of various materials, but especially and traditionally of wicker, straw, chestnut strips, plastic strips or strings; this feature makes them a specially suitable product for craft-ware in countries where the cost of labour is low and from which these products are exported in considerable quantities.

The drawback of these baskets lies in the very high transport costs owing to the impossibility of piling the baskets in such a way as to form packagings with a convenient weight/volume ratio.

In addition to the above baskets, made of wicker, straw and other above mentioned material, also document U.S. Pat. No. 2,405,310 is known that discloses a basket handle connectable with a container. The handle is made of sheet material, the container is formed by fiber board and similar materials side walls in the form of an outer panel and an inner panel and therebetween connecting means in the handle and in the container are cooperating; the handle disclosed in said document results detachable.

We shall conventionally term the part of the basket that holds objects—the tray—and the part of the basket that serves as a handle—the handle.

SUMMARY OF THE INVENTION

The present invention obviates the above mentioned drawback and, as characterized in the claims, is a basket in which the tray bears at least a first engagement means on each opposite side, and at each of its sides the handle bears at least a second engagement means, the first and second engagement means being suited to engage rigidly so that the tray and handle result as being solidly and permanently locked to one another so as to form a single object.

The main advantage of this basket lies in the fact that the manufacturer separately produces the trays and the handles for the transport of which any desirable number of trays will be piled onto one another into packages and an equal number of handles will be packaged one next to another, with an enormous reduction in the volumes required and, consequently, in the cost of transport. Each tray and each handle will be assembled in the importing country.

The first engagement means is a body provided with a hollow, which body being held, thanks to retaining means, within a lodging formed on one side of the tray and the second engagement means is a pin shaped body formed by a first part held, thanks to retaining means, in the end of the handle and by a second part to be forced into the hollow of the first engagement means.

Alternatively, the first engagement means in the tray is the pin shaped body and the second engagement means in the handle is the body provided with a hollow into which the first means may be forced.

The lodging for the first engagement means is formed in the border of the tray.

Alternatively, the lodging for the first engagement means is formed in the side of the tray.

BRIEF DESCRIPTION OF THE DRAWINGS

The invention will be illustrated in further detail below with an example of an embodiment and with the support of the drawings in which the baskets represented are made of wicker-work, though the material is not shown in detail owing to the complexity that the pattern of the wicker-work features; in the drawings.

DESCRIPTION OF THE PREFERRED EMBODIMENTS

Figure 1:
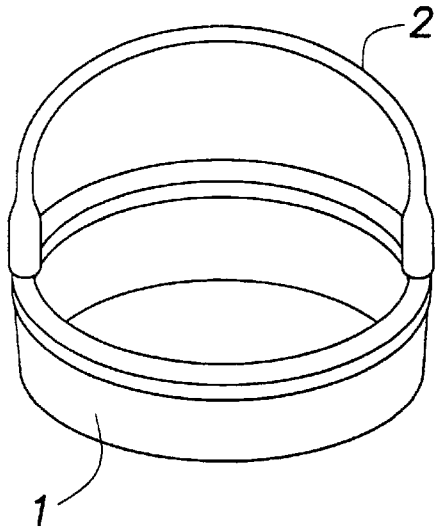
FIG. 1 is a first perspective view.

FIG. 1 shows a tray 1 and handle 2 of a basket that, fastened to one another thanks to the engagement means foreseen, form a basket complying with the present invention.

Figure 2:
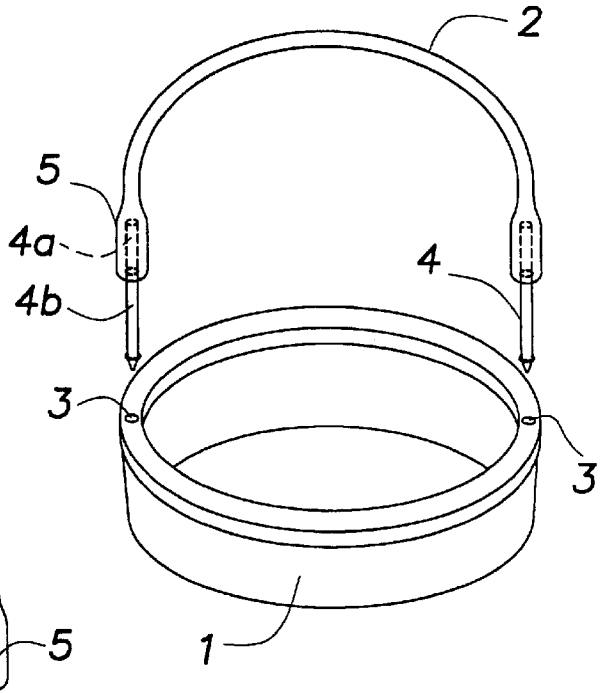
FIG. 2 is a second perspective view.

FIG. 2 shows how the tray 1 of the basket, incorporated in two diametrically opposite points of its upper border, bears two hollow engagement means 3 into which each of the pins 4*b* of engagement means 4 that has part 4*a* firmly incorporated in the thicknesses 5 of the ends of handle 2 may be forced. Both engagement means 3 and 4 are of appropriate plastic material, but it is understood that they may be of other suitable materials, such as metal, wood, bamboo.

Figure 3:
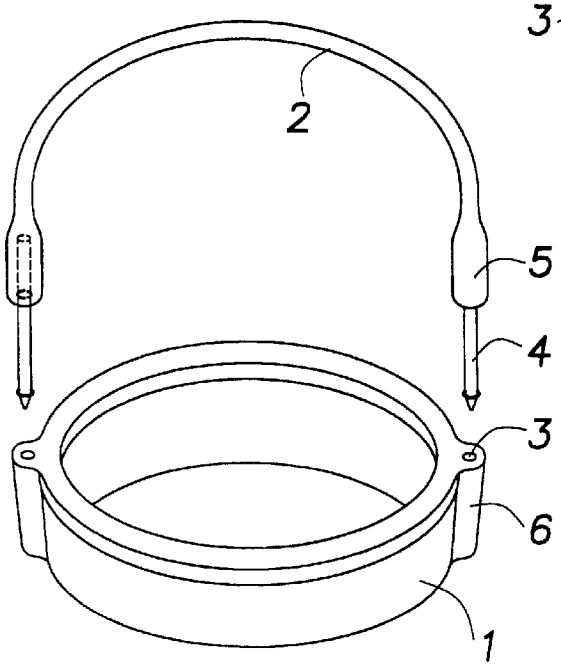
FIG. 3 is a third perspective view.

FIG. 3 shows how each engagement means 3 in tray 1 is incorporated in a thickness 6 formed on the outside of the side wall.

Figure 4A:
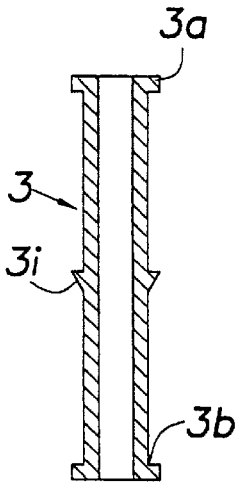
FIGS. 4*a*–4*b* and 5*a* and 5*b* show details.
Figure 4B:
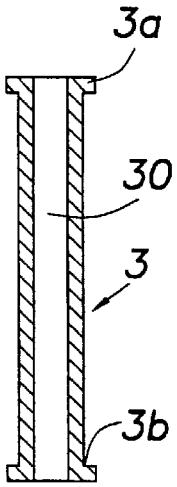
Figure 4C:
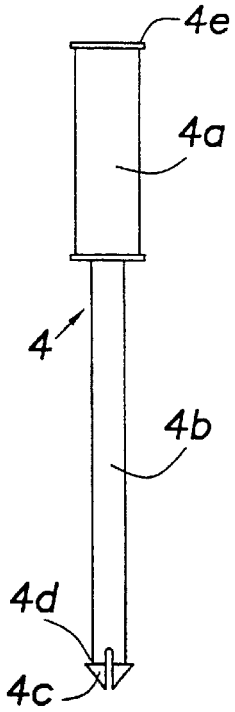
Figure 4D:
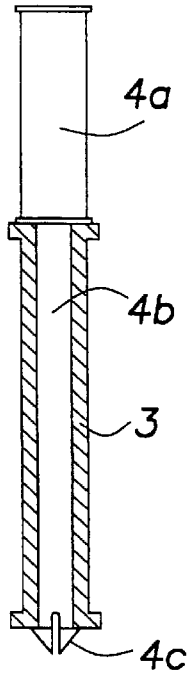
Figure 8:
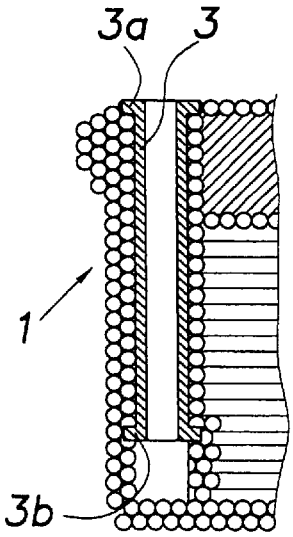

FIGS. 4*a*–4*d* show the detail of the two engagement means and their coupling;

FIG. 4*a* shows means 3 provided with cylindric hollow 30 prepared to be incorporated in the tray during the production of the same, as shown in FIG. 8; it is understood that the upper annular part 3*a* serves as a base for the end of the handle and the lower annular part 3*b* serves to lock the means within the tray;

FIG. 4*b* shows how an annular part 3*i* may also be foreseen in an intermediate position along the means 3;

FIG. 4*c* shows how means 4 features the upper part 4*a* prepared to be incorporated in the end of the handle during production and the cylindric pin shaped lower part 4*b* to be sunk into the hollow 30 of means 3 and hence be locked therein by the plastic point 4*c* with an annular relief 4*d*, FIG. 4*d* shows the two parts 3 and 4 as coupled.

Figure 5A:
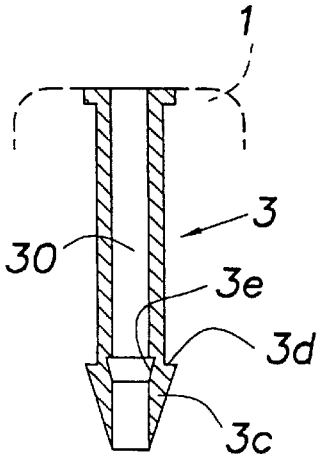
Figure 5B:
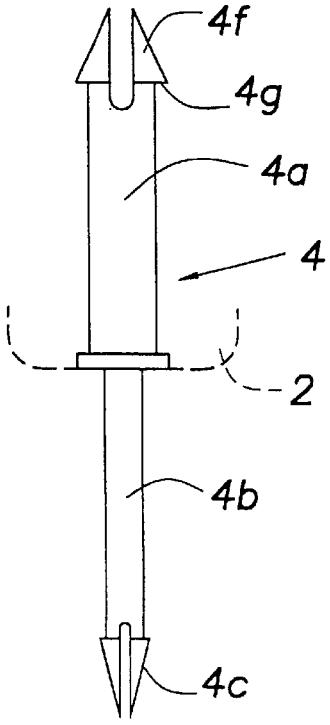

FIGS. 5*a* and 5*b* show an alternative solution to the one illustrated in FIGS. 4*a*–4*d:*

FIG. 5*a* shows a means 3 that bears an elastic point 3*c* in its lower part with an annular relief 3*d*; while towards the lower end of the internal hollow 30 a triangular groove 3*e* is formed into which the annular relief 4*d* of the elastic point 4*c* of part 4*b* will engage;

FIG. 5*b* shows a means 4 that bears in its upper part an elastic point 4*f* with annular relief 4*g*. This embodiment allows to incorporate the means 3 and the means 4 into a corresponding hollow appropriately formed during the manufacturing stage, respectively in the tray and in the ends of the handle, or viceversa, so that the two means become unmovable in their seats as if they had been incorporated during the manufacturing.

Figure 6:
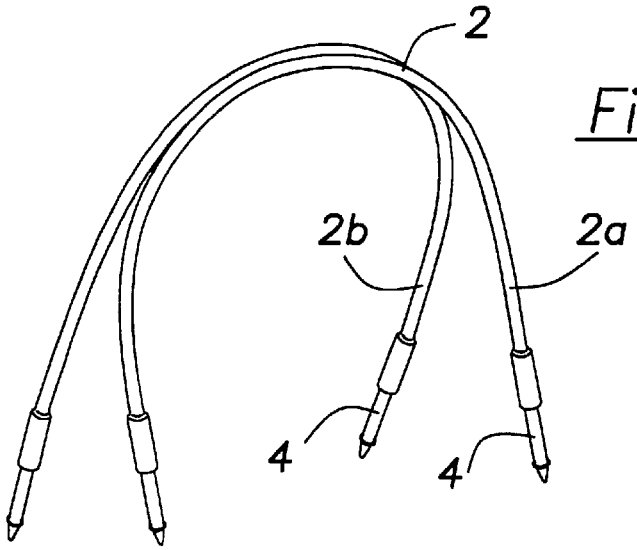
FIGS. 6 and 7 are other perspective views and FIG. 8 shows a further detail.
Figure 7:
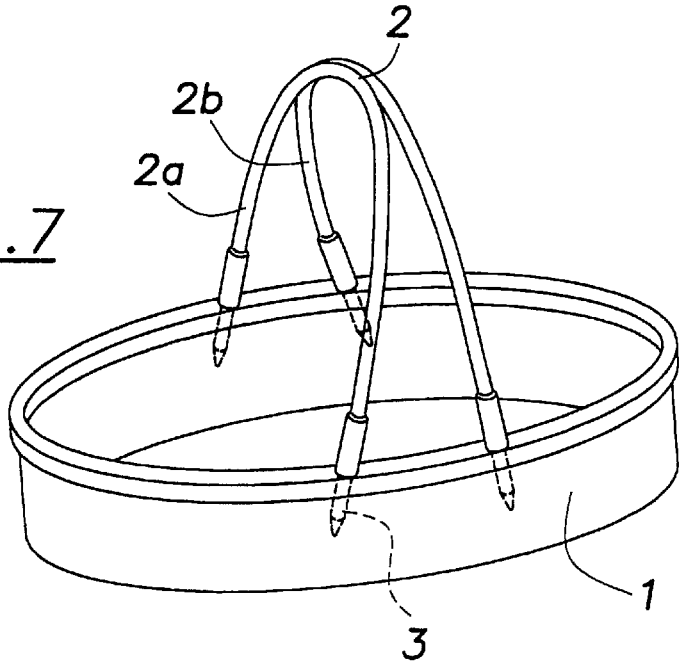

FIGS. 6 and 7 show a handle 2 with four ends, 2*a* and 2*b* for each side, each one incorporating an engagement means 4 that engages in a corresponding engagement means 3 of tray 1.

FIG. 8, as stated with reference to FIG. 4, shows an engagement means 3 in detail, with its parts 3*a* and 3*b*, that has been incorporated in a wicker-work tray during the production.

The way to make the retaining in the basket and the coupling of first and second engagement means easier, is the one represented in the figures: means 3 is a cylindric body with cylindric hollow 30 and means 4 is a body with cylindrical part 4*a* and pin part 4*b* cylindrical too which may be forced into the hollow 30. It is understood, however, the the shaped of said parts may also be not cylindrical, provided they allow the retaining into the basket and the necessary coupling.

What is claimed is:

1. A basket with an arc shaped handle (2), a tray (1) bearing on each side at least a first engagement means (3) and a handle (2) bearing at each of its ends at least a second engagement means (4), characterized in that the first engagement means (3) is a body provided with a hollow (30) held in position by retaining means (3*b*, 3*c*, 3*i*) within one side of the tray and the second engagement means (4) is a pin shaped body formed by a first part (4*a*) held by retention means (4*e*, 4*f*) in the ends of the handle and by a second part (4*b*) that is adapted to be forced into the hollow (30) of the first engagement means (3), the first and second engagement means being structured and arranged to rigidly couple so that the tray (1) and the handle (2) become solidly and permanently locked to one another, and wherein the internal end of the body (3) provided with the hollow (30) and of the pin shaped body (4) each bear an elastic point (3*c*, 4*f*) with an annular relief (3*d*, 4*g*) in order to irremovably engage within the basket.

2. A basket according to claim 1, characterized in that the lodging for the first engagement means (3) is formed on the border of the tray (1).

3. A basket according to claim 1 characterized in that the lodging for the first engagement means (3) is formed in a thickness (6) formed in the side of the tray (1).

4. A basket according to claim 1 characterized in that the end of the pin shaped body (4*b*) bears an elastic point (4*c*) with a perimeter relief (4*d*) such as to engage it firmly within the body (3) provided with a hollow (30).

5. A basket comprising:

a tray having an upper peripheral surface, and at least one recess on opposite sides of the peripheral surface; each recess being fitted with a first engagement means;

an arc-shaped handle bearing at each of its ends at least a second engagement means;

each first engagement means comprising a hollow body having on its outer surface means for retaining the body within a respective recess;

each second engagement means comprising a pin-shaped element formed by a first part held by retention means in a respective end of the handle, and by a second part that is adapted to be forced in the hollow body of a respective first engagement means; and said first and second engagement means being structured and arranged to rigidly couple to one another so that the tray and handle become solidly and permanently locked to one another.

6. The basket according to claim 5, wherein each hollow body has a first end substantially flush with the upper peripheral surface, and an opposite internal second end; said internal second end bearing an elastic point with an annular relief for irremovably engaging within the basket.

7. The basket according to claim 5, wherein each recess and first engagement means are positioned in a thickness protruding in the side of the tray.

8. The basket according to claim 5, wherein the second part of the pin-shaped body has an end which bears an elastic point with a perimeter relief such as to engage it firmly with the hollow body.

9. The basket according to claim 5, wherein the first and second engagement means are made of plastic material.

10. The basket comprising: an arc-shaped handle having at each of its ends at least one recess; each recess being fitted with a first engagement means;

a tray having an upper peripheral surface and at least a second engagement means on opposite sides of the peripheral surface;

each first engagement means comprising a hollow body having on its outer surface means for retaining the body within a respective recess;

each second engagement means comprising a pin-shaped element formed by a first part held by retention means within the tray, and by a second part that it adapted to be forced in the hollow body of a respective first engagement means; and said first and second engagement means being structured and arranged to rigidly couple to one another so that the tray and handle become solidly and permanently locked to one another.

* * * * *